US006642188B1

(12) United States Patent
Hartley et al.

(10) Patent No.: US 6,642,188 B1
(45) Date of Patent: Nov. 4, 2003

(54) LUBRICATING OIL COMPOSITION FOR OUTBOARD ENGINES

(75) Inventors: Rolfe J. Hartley, Cranbury, NJ (US); Salvatore Rea, Franklin Square, NY (US); Malcolm Waddoups, Westfield, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/191,017

(22) Filed: Jul. 8, 2002

(51) Int. Cl.[7] ..... C10M 14/10; C10M 141/12

(52) U.S. Cl. ..... 508/291; 508/364; 508/365; 508/408; 508/433; 508/438; 508/579; 508/584

(58) Field of Search ..... 508/291, 364, 508/365, 408, 433, 438, 579, 584

(56) References Cited

U.S. PATENT DOCUMENTS 4,178,258 A * 12/1979 Papay et al. ..... 508/363
4,375,418 A * 3/1983 Zoleski et al. ..... 508/277
5,364,545 A * 11/1994 Arai et al. ..... 508/365
5,629,272 A * 5/1997 Nakazato et al. ..... 508/185
6,074,993 A * 6/2000 Waddoups et al. ..... 508/364
6,143,701 A * 11/2000 Boffa ..... 508/363
6,162,769 A * 12/2000 Polhaar et al. ..... 508/339
6,207,625 B1 * 3/2001 Ogano et al. ..... 508/365
6,300,291 B1 * 10/2001 Hartley et al. ..... 508/363
6,323,162 B1 * 11/2001 Yasunori et al. ..... 508/192
6,423,670 B2 * 7/2002 Locke et al. ..... 508/192
6,423,671 B1 * 7/2002 Haruna ..... 508/365

* cited by examiner

*Primary Examiner*—Jacqueline V. Howard

(57) ABSTRACT

The lubricating compositions of the present invention are designed for use in a four stroke outboard marine engine and contain an oil of lubricating viscosity, an ashless dispersant, a metal detergent, a rust inhibitor, a relatively high amount of ZDDP, and an amount of a molybdenum compound sufficient to provide the composition with 15–1,000 ppm by mass of molybdenum. An amount of about 15 ppm to 1,000 ppm by mass of molybdenum from a molybdenum compound has been found to be effective as an antiwear agent in combination with the high levels of ZDDP.

14 Claims, No Drawings

LUBRICATING OIL COMPOSITION FOR OUTBOARD ENGINES

The present invention relates to lubricating oil compositions. More particularly, the present invention relates to lubricating oil compositions, which are designed for use with four cycle outboard marine engines.

BACKGROUND OF THE INVENTION

The invention embodies new oil blends specifically formulated for use in four cycle outboard engines. These oils are differentiated from crankcase oils by a high phosphorus level. These oils also contain a molybdenum antioxidant/antiwear additive and a rust inhibitor additive.

Current practice for four cycle outboard oils is to use heavy duty diesel oils. This technology was never designed to meet the specific performance needs of four cycle outboard engines. The oils embodied in this invention provide specific performance improvements desirable in four cycle outboard engines: improved antioxidancy, antiwear, rust inhibition, shear stability, good water tolerance, air entrainment and high temperature foam properties.

SUMMARY OF THE INVENTION

In accordance with the invention, there is provided a lubricating oil composition for use in four cycle outboard marine engines, which composition comprises at least one oil of lubricating viscosity, an ashless dispersant, a metal detergent, at least one molybdenum compound in an amount sufficient to provide the composition with 15 to 1,000 ppm by mass, of molybdenum, an amount of ZDDP (zinc dialkyldithiophosphate) that contributes at least 1,200 ppm of phosphorus to the lubricating oil composition, an effective amount of a rust inhibitor and, optionally, a viscosity modifier, the lubricating oil composition having a NOACK volatility of 15 wt. % or less.

A further embodiment of this invention comprises a method of operating and lubricating a four cycle outboard marine engine which comprises supplying to said engine the lubricating oil composition of this invention.

DESCRIPTION OF THE PREFERRED EMBODIMENTS

The lubricating compositions of the present invention contain an oil of lubricating viscosity, an ashless dispersant, a metal detergent, a rust inhibitor, a relatively high amount of ZDDP, and an amount of a molybdenum compound sufficient to provide the composition with 15–1,000 ppm by mass of molybdenum. An amount of about 15 ppm to 1,000 ppm by mass of molybdenum from a molybdenum compound has been found to be effective as an antiwear agent in combination with the high levels of ZDDP.

It is also necessary that the volatility of the lubricating oil composition, as measured using the NOACK Volatility Test, be about 15 wt. % or less, such as in the range of 4 to 15 wt %, preferably in the range of 8 to 15 wt %. The NOACK Volatility Test is used to measure the evaporative loss of an oil after 1 hour at 250° C. according to the procedure of ASTM D5800. The evaporative loss is reported in mass percent.

The oil of lubricating viscosity useful in the context of the present invention is selected from the group consisting of Group I, Group II, or Group III, Group IV or Group V base stocks or base oil blends of the aforementioned base stocks. Generally, the viscosity of such oils ranges from about 2 $mm^2$/sec (centistokes) to about 40 $mm^2$/sec at 100° C. Preferred are base stocks or base stock mixtures having an intrinsic viscosity of from about 4.0 to about 5.5 $mm^2$/sec at 100° C. Further preferable are base stocks and base stock mixtures having a volatility, as measured by the NOACK test (measured by determining the evaporative loss in mass percent of an oil after 1 hour at 250° C. according to the procedure of ASTM D5800), of less than 15%, more preferably less than 12%, most preferably less than 10%. The most preferred oils are:

(a) Base oil blends of Group III, IV or V base stocks with Group I or Group II base stocks, where the combination has a viscosity index of at least 110; and (b) Group III, IV or V base stocks or base oil blends of more than one Group III, IV and/or V base stock, where the viscosity index is between about 120 to about 140.

Definitions for the base stocks and base oils in this invention are the same as those found in the American Petroleum Institute (API) publication "Engine Oil Licensing and Certification System", Industry Services Department, Fourteenth Edition, December 1996, Addendum Dec. 1, 1998. Said publication categorizes base stocks as follows:

a.) Group I base stocks contain less than 90 percent saturates and/or greater than 0.03 percent sulfur and have a viscosity index greater than or equal to 80 and less than 120 using the test methods specified in Table E-1.

b.) Group II base stocks contain greater than or equal to 90 percent saturates and less than or equal to 0.03 percent sulfur and have a viscosity index greater than or equal to 80 and less than 120 using the test methods specified in Table E-1.

c.) Group III base stocks contain greater than or equal to 90 percent saturates and less than or equal to 0.03 percent sulfur and have a viscosity index greater than or equal to 120 using the test methods specified in Table E-1.

d.) Group IV base stocks are polyalphaolefins (PAO).

e.) Group V base stocks include all other base stocks not included in Group I, II, III, or IV, such as synthetic ester base stocks.

Lubricating compositions of this invention which exhibit a biodegradability of at least 50% in the ASTM D5864-95 modified Sturm test may be prepared using synthetic ester base stocks prepared from polyhydric or monohydric alcohols and carboxylic acids.

TABLE E-1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Suitable ashless dispersants for use in this invention include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,361,673 and 4,234,435. Mixed ester-amides of hydrocarbyl-substituted succinic acids are described, for example, in U.S. Pat. Nos. 3,576,743; 4,234,435 and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos. 3,275,554; 3,438,757; 3,454,55 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly (ethyleneamines) averaging about 5 to 7 nitrogen atoms per molecule are available commercially under trade names such as "Polyamine H", "Polyamine 400", "Dow Polyamine E-100", etc. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

The amine is readily reacted with the selected hydrocarbyl-substituted dicarboxylic acid material, e.g., alkylene succinic anhydride, by heating an oil solution containing 5 to 95 wt. % of said hydrocarbyl-substituted dicarboxylic acid material at about 100° C. to 250° C., preferably 125° C. to 175° C., generally for 1 to 10, e.g., 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition derived from reaction of polyolefin and maleic anhydride having a functionality of 1.6; i.e., preferably the pentamine is used in an amount sufficient to provide about 0.4 equivalents of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight (Mn) in the range of 300 to 2500 (preferably 1600 to 2500). The polyisobutenyl succinic anhydride used to prepare the dispersant may be chlorine-free such as one made from a highly reactive, terminally unsaturated polyisobutylene or it may be a mixture of chlorine-containing and chlorine-free polyisobutenyl succinic anhydride such that the finished oil has less than 50 ppm chlorine.

The ashless dispersants of the invention should be present, on an active ingredient basis, in an amount of from 1.0 to 3.25 wt %. Heavy duty diesel lubricants commonly used as four cycle outboard lubricants will typically have 4–8 wt % of dispersant.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450 and mixtures of calcium phenates and sulfonates.

Metal detergents are present typically in amounts of 0.25 to 3.0 wt % on an active ingredient basis.

For the lubricating oil compositions of this invention, any suitable soluble organo-molybdenum compound having anti-wear properties in lubricating oil compositions may be employed. As an example of such soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

The molybdenum compound may be mono-, di-, tri- or tetra-nuclear. Dinuclear and trinuclear molybdenum compounds are preferred. The molybdenum compound is preferably an organo-molybdenum compound. More preferably, the molybdenum compound is selected from the group consisting of a molybdenum dithiocarbamate (MoDTC), molybdenum dithiophosphate, molybdenum dithiophosphinate, molybdenum xanthate, molybdenum thioxanthate, molybdenum sulfide and mixtures thereof. Most preferably, the molybdenum compound is present as molybdenum dithiocarbamate or a trinuclear organo-molybdenum compound.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4$$

and $$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

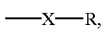

2

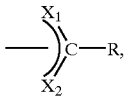

3

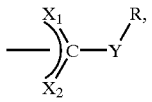

-continued

4

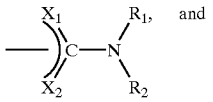

and

5

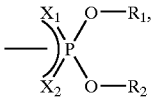

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).
2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmer capto, nitro, nitroso, sulfoxy, etc.).
3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

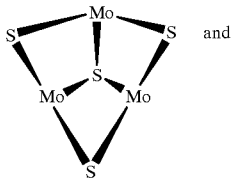

and

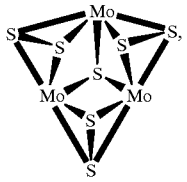

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. Such structures fall within the scope of this invention. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligand's organo groups. Preferably, the ligand source chosen has a sufficient number of carbon atoms in its organo groups to render the compound soluble or dispersible in the lubricating composition.

Preferably the composition of this invention will contain about 25–300 ppm molybdenum.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

Zinc dihydrocarbyl dithiophosphate (ZDDP) metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The composition of this invention will contain ZDDP in such amounts so as to provide at least 1,200 ppm P in the finished outboard engine oil, up to about 2,000 ppm P.

The preferred zinc dihydrocarbyl dithiophosphates are oil soluble salts of dihydrocarbyl dithiophosphoric acids and may be represented by the following formula:

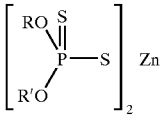

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms or mixtures thereof. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The zinc dialkylthiophosphate compound can be primary zinc, secondary zinc, or mixtures thereof, that is, the ZDDP contains primary and/or secondary alkyl groups derived from primary or secondary alcohols, but secondary alkyl groups are preferred, or ZDDP which has about 85% secondary alkyl groups and about 15% primary alkyl groups, such as 85% sec-butyl and 15% iso-octyl.

It is essential that the outboard marine engine oil compositions of the present invention contain an effective amount of an oil soluble rust inhibitor. Such amounts vary from 0.05 to about 1.5 wt %, preferably about 0.2 to 0.5 wt %. Preferred is an ethoxylated nonylphenol or $C_4$–$C_{18}$ alkyl phenol rust inhibitor containing about 2 to 10, preferably 3 to 5, moles of ethylene oxide per mol. Other suitable rust inhibitors include: fatty acid, alkenyl succinate half ester, fatty acid soap, ester of fatty acid and polyhydric alcohol, ethoxylated amines, fatty acid amine, oxidized paraffin, alkyl polyoxyethylene ether, nonionic polyoxyalkylene polyols and esters thereof, other polyoxyalkylene phenols, anionic alkyl sulfonic acids, metal salts of alkyl naphthalene sulfonic acids such as "NA-SUL 129", available from King Industries, and dialkyl hydrogen phosphites or phosphates.

The compositions of the present invention will contain effective amounts of a viscosity modifier as an optional ingredient depending on the viscosity grade of the oil which is desired. These are typically present in amounts ranging from 0.5 to 5.0 wt % on an active ingredient basis. Shear stable viscosity modifiers are preferred.

Suitable compounds for use as viscosity modifiers are generally high molecular weight hydrocarbon polymers, including polyesters. Oil soluble viscosity modifying polymers generally have weight average molecular weights from about 10,000 to 1,000,000, preferably from about 20,000 to 500,000, as determined by gel permeation chromatography or light scattering methods.

Representative examples of suitable viscosity modifiers are polyisobutylene, copolymers of ethylene and propylene and higher alpha-olefins, polymethacrylates, polyalkylmethacrylates, methacrylate copolymers, copolymers of unsaturated dicarboxylic acid and vinyl compound, inter polymers of styrene and acrylic ester, and partially hydrogenated copolymers of styrene/isoprene, styrene/butadiene and isoprene/butadiene, as well as partially hydrogenated homopolymers of butadiene and isoprene and isoprene/divinylbenzene.

Additional additives may be present in the composition of the present invention include stabilizers and seal compatibility additives such as polyisobutenyl succinic anhydride, prepared from chlorinated polyisobutylene or chlorine-free polyisobutylene, including highly reactive polyisobutylene having terminal unsaturation, oxidation inhibitors, demulsifiers, antifoam additives and pour depressants.

The compositions of this invention may also contain 0.05 to 1.5 wt % each of one or more phosphorus-free oxidation inhibitors or antioxidants, and these include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, sulfurized hydrocarbons, metal thiocarbamates and oil soluble copper compounds as described in U.S. Pat. No. 4,867,890.

Aromatic amines having at least two aromatic groups attached directly to the nitrogen constitute another class of compounds that is frequently used for antioxidancy. Typical oil soluble aromatic amines having at least two aromatic groups attached directly to one amine nitrogen contain from 6 to 16 carbon atoms. The amines may contain more than two aromatic groups. The aromatic rings are typically substituted by one or more substituents selected from alkyl, cycloalkyl, alkoxy, aryloxy, acyl, acylamino, hydroxy, and nitro groups. Dinonyl-diphenyl amine is a preferred antioxidant. The amount of any such oil soluble aromatic amines having at least two aromatic groups attached directly to one amine nitrogen is in the range of 0.05 to 1.5 wt. % active ingredient. The use of at least one of a hindered phenol and aromatic amine antioxidant, or the combination of both, is preferred. Hindered phenols are preferably used in the range of 0.05 to 0.5 wt %. Hindered phenols will generally be of the type in which there is a sterically hindered phenolic group, especially one containing a t-butyl group in the ortho position to the phenolic OH group. Examples of such compounds are many. These include both monocyclic and bisphenols. Preferred examples are tetrakis(methylene-3-(-3',5'-di-tert-butyl-4'hydroxyphenyl)-propionate)methane; octadecyl-3-(3',5'-di-tert-butyl-4'-hydroxyphenyl) propionate; 1,3,5-trimethyl-2,4,6-tris(3,5-di-tert-butyl-4-hydroxybenzyl)benzene; 4,4'-(2,2-diphenylpropyl)-diphenylamine; esters of ethoxylated aryl phenols; 2,2'-thiodiethylbis(3-(3,5-di-tert-butyl4-hydroxyphenyl) propionate; octadecyl-3,5-di-tert-butyl-4-hydroxyhydrocinnamate and mixtures of any of the foregoing. Most preferred is isooctyl-3,5-di-tert-butyl4-hydroxyhydrocinnamate, which is commercially available as "Irganox L-135".

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many antifoam compounds including a fluorosilicone or an antifoamant of the polysiloxane type, for example, silicone oil or polydimethyl siloxane usually used in amounts of from 0.0001 to 0.01 wt % active ingredient.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final lubricating oil formulation may employ from 2 to 20 mass %, preferably 4 to 18 mass %, and most preferably about 5 to 17 mass % of the concentrate or additive package with the remainder being base stock.

EXAMPLE

The following 10W30 viscosity grade oil was prepared and tested for suitability as a four stroke outboard marine engine oil. Percentages are by weight of active ingredient, except as otherwise indicated. The oil has 50 ppm molybdenum, 1450 ppm phosphorus and a NOACK volatility less than 15%.

Lubricating Oil Formulation

| | Weight % |
|---|---|
| (a) Calcium sulfonate (TBN 300) | 0.880 |
| (b) Molybdenum trimer dithiocarbamate | 0.045 |
| (c) Calcium phenate (neutral) | 0.460 |
| (d) Polyisobutenyl succinimide dispersant | 2.450 |
| (e) Amine antioxidant | 0.600 |

-continued

| Lubricating Oil Formulation | Weight % |
|---|---|
| (f) Hindered phenol antioxidant | 0.100 |
| (g) Viscosity modifier (as 15% solution of polymer) | 6.000 |
| (h) ZDDP | 1.350 |
| (i) Ethoxylated nonyl phenol rust inhibitor | 0.200 |
| (j) Lube oil flow improver | 0.300 |
| (k) Silicone antifoam agent | 0.001 |
| (l) Mineral oil basestocks | Balance |

A series of tests were carried out in the oil listed in the Example above to indicate its suitability for use as a four stroke outboard marine engine oil. These tests were for Rust, Water Tolerance, Air Entrainment, Foaming and Oxidation. The "Comparison Oil" was a commercial heavy duty diesel engine lubricant commonly used as a four stroke outboard oil which contained 4.4 wt % dispersant, had 1250 ppm P from ZDDP and did not contain a molybdenum additive.

Rust - ASTM D665 B

| Oil | Result |
|---|---|
| Example | Pass |
| Comparison | Fail (2 of 3 tests) |

Water Tolerance

GMEOFT (General Motors Engine Oil Filterability Test)

Pass is less than 50% change in flow rate for oil plus water after 0.6% water is emulsified in the oil.

| Oil | Result |
|---|---|
| Example | Pass (−2.7% flow rate) |
| Comparison | Pass (−1.3% flow rate) |

Air Entrainment—ASTM D3427

Test measures gas bubble separation time at 50° C. as air release value; no standards for pass or fail have been established for this test.

| Oil | Result |
|---|---|
| Example | 15.5 minutes (air release value) |
| Comparison | 18.9 minutes (air release value) |

High Temperature Foaming - ASTM D6082

| Oil | Result | |
|---|---|---|
| Example | Foaming Tendency | 30 mls. (pass) |
| | Settling Time | 11 seconds |
| Comparison | Foaming Tendency | 110 mls. (fail) |
| | Settling Time | 14 seconds |

Note: For SAE GF-3 passenger car motor oils, a "pass" is 100 mls or lower.

Oxidation - (Thermo-Oxidation Engine Oil Simulation Test - described in SAE 932837)

| Oil | Result |
|---|---|
| Example | 22.5 mgs deposits at 285° C. (pass) |
| Comparison | 51.0 mgs deposits at 285° C. (fail) |

Note: The SAE GF-3 "pass" is 45 mgs or less at 285° C.

While no formal standards have as yet been adopted for four stroke outboard marine engine oils, the oil of the Example exhibits somewhat consistently improved performance over the Comparison oil in the five tests above which are considered highly relevant in assessing the performance of a marine engine oil.

What is claimed is:

1. A lubricating oil composition suitable for use in a four stroke outboard marine engine which comprises an oil of lubricating viscosity containing an admixture of (a) 1–3.25 wt % of an ashless dispersant;

(b) a metal detergent;

(c) an oil soluble molybdenum compound in an amount sufficient to provide 15–1,000 ppm molybdenum in the composition;

(d) a zinc dialkyl dithiophosphate in an amount sufficient to provide at least 1,200 ppm phosphorus in the composition;

(e) a rust inhibitor; and (f) optionally, a viscosity modifier, said composition having a NOACK volatility less than 15%.

2. The composition of claim 1 wherein the metal detergent is a calcium sulfonate or a calcium phenate or mixtures thereof.

3. The composition of claim 1 wherein the dispersant is a polyisobutenyl succinimide wherein the polyisobutenyl has a Mn of 1600–2500.

4. The composition of claim 1 wherein the molybdenum compound is a molybdenum dithiocarbamate.

5. The composition of claim 1 wherein the molybdenum compound is a trinuclear compound of the formula $Mo_3S_kL_nQ_z$ wherein L represents oil soluble organo groups, n is 1–4, k is 4–7 and Q is a neutral electron donating compound and z is 0–5.

6. The composition of claim 1 wherein the zinc dialkyl dithiophosphate is present in an amount sufficient to provide up to 2,000 ppm P in the composition.

7. The composition of claim 6 wherein the zinc dialkyl dithiophosphate comprises secondary alkyl groups having 2 to 8 carbon atoms.

8. The composition of claim 1 wherein there is present 0.05 to 1.5 wt. % of the rust inhibitor.

9. The composition of claim 8 wherein the rust inhibitor is an ethoxylated alkyl phenol containing 2 to 10 moles of ethylene oxide per mole.

10. The composition of claim 1 wherein the viscosity modifier is shear stable and is present in an amount of 0.5 to 5.0 wt %.

11. The composition of claim 1 further comprising one or more phosphorus-free antioxidants.

12. The composition of claim 1 further comprising an antifoam agent.

13. The composition of claim 1 further comprising a lube oil flow improver.

14. A method of operating and lubricating a four cycle outboard marine engine which comprises supplying to the engine the lubricating oil composition of claims 1–13.

* * * * *